US010571220B2

(12) United States Patent
Toschi

(10) Patent No.: US 10,571,220 B2
(45) Date of Patent: Feb. 25, 2020

(54) FIREARM HOLSTER ADAPTABLE TO WEAPONS OF DIFFERENT SIZES

(71) Applicant: VEGA HOLSTER S.R.L., Calcinaia (PI) (IT)

(72) Inventor: Francesco Toschi, Santa Croce sull'Arno (IT)

( * ) Notice: Subject to any disclaimer, the term of this patent is extended or adjusted under 35 U.S.C. 154(b) by 0 days.

(21) Appl. No.: 16/167,704

(22) Filed: Oct. 23, 2018

(65) Prior Publication Data

US 2019/0353450 A1 Nov. 21, 2019

(30) Foreign Application Priority Data

May 21, 2018 (IT) ..... 202018000002589

(51) Int. Cl.
*F41C 33/02* (2006.01)
*F41C 33/04* (2006.01)

(52) U.S. Cl.
CPC ..... *F41C 33/04* (2013.01); *F41C 33/0227* (2013.01)

(58) Field of Classification Search
CPC .. F41C 33/04; F41C 33/0337; F41C 33/0209; F41C 33/0236
USPC ..... 224/243, 931; 220/4.33
See application file for complete search history.

(56) References Cited

U.S. PATENT DOCUMENTS

| | | | | |
|---|---|---|---|---|
| 3,160,307 | A * | 12/1964 | Morrison | B65D 11/1873 220/4.33 |
| 7,258,259 | B1 * | 8/2007 | Owens | A45F 5/02 224/192 |
| 9,394,080 | B2 * | 7/2016 | Beck | B65D 21/08 |
| 9,744,717 | B2 * | 8/2017 | Miller | B29C 61/02 |
| 9,759,536 | B2 * | 9/2017 | Gadams | F42B 39/02 |
| 10,352,652 | B2 * | 7/2019 | Higdon, Jr. | F41C 33/0209 |
| 2005/0221762 | A1 * | 10/2005 | Greene | A45F 5/021 455/66.1 |
| 2016/0066680 | A1 * | 3/2016 | Hazeltine | A45F 5/021 224/676 |
| 2016/0153745 | A1 * | 6/2016 | Higgins | F41A 23/18 206/317 |
| 2016/0209163 | A1 * | 7/2016 | VanHeusen | A45F 5/02 |
| 2017/0099934 | A1 * | 4/2017 | Evans | F42B 39/02 |

* cited by examiner

*Primary Examiner* — Adam J Waggenspack
(74) *Attorney, Agent, or Firm* — Themis Law

(57) ABSTRACT

A holster for a firearm includes a first wall and a second wall delimiting, at least in part, an area for containing the firearm. The first and the second walls are connected to each other with one or more elastic elements.

8 Claims, 6 Drawing Sheets

FIREARM HOLSTER ADAPTABLE TO WEAPONS OF DIFFERENT SIZES

FIELD OF THE INVENTION

The present invention refers to the technical field of holsters for firearms, for example automatic guns and revolvers.

In particular, the present invention refers to a particular holster which is adapted to house firearms of different sizes inserted therein.

BACKGROUND OF THE INVENTION

Holsters for firearms have long been known and are available in multiple varieties.

Some holsters are made of fabric while others, in particular newer generation holsters, are made of a pourable rigid material, such as a plastic material.

The holster forms a receiving site delimited by the walls of the holster, in which the firearm can be housed.

The holster has standard joints, in order to be fastened firmly, for example to a belt wearable by the user. In this manner, the user has a weapon-holder support which is always positioned at waist level.

It could be equally positioned at armpit, thigh or ankle level. Moreover, by means of suitable tactical waistcoats, it could be positioned at chest or breast level.

Moreover, some prior art holsters has safety systems for fastening the weapon, which act on the trigger guard, the butt or other parts of the weapon, in order to prevent the weapon from being fraudulently pulled and to keep it in position in the holster.

Current holsters, in particular those made of rigid materials, are generally made up in a single piece, in which the walls shaping the holster (for example two lateral walls, an anterior one and a posterior one) are continuous with each other.

In this sense, therefore, it is obvious that the space provided for the slot of the weapon is fixed and cannot be modified. In particular, it is predetermined for a specific type of weapon and cannot be adapted to receive weapons (and therefore models) with different sizes.

Thus, if a holster is intended for a specific weapon of a predetermined size, it is not possible to insert a weapon of a bigger or smaller size.

Therefore, if the weapon is bigger, it cannot be fitted in the provided slot, because the size of the slot for the weapon cannot be changed.

Equally, if the weapon is smaller, it is also not correctly fastened.

Because of this limitation, each time it is necessary to provide for many holsters with different shapes and sizes, each one for a specific weapon.

These inconveniences are felt more greatly with holsters for uncommon weapons, which are less available on the market, or may not be not produced at all or are anyway hard to find.

SUMMARY OF THE INVENTION

It is therefore an aim of the present invention to solve at least in part said technical inconveniences.

In particular, an aim of the present invention is to provide for a holster that is adaptable and therefore can house firearms of different sizes.

These and other aims are achieved with a holster, as described thereinafter.

A holster according to the invention comprises at least a first wall (10A, 20B) and at least a second wall delimiting, at least in part, an area (30) for containing the firearm.

According to the invention, said first and second walls are connected each other through elastic means (40).

In this manner, the two said walls, starting from an initial rest position move away from each other because the elastic means connecting them can stretch, thus increasing the size of the area configured to slot the firearm.

Therefore, starting from a minimum initial size, such area can be increases as a function of the elastic stretch of the elastic means that have been used, thus enabling a user to slot firearm of increasing sizes, starting from a minimum size.

In this manner an adaptable and low-cost holster can be obtained.

Additional advantages can be inferred from the following description.

BRIEF DESCRIPTION OF THE DRAWINGS

Further features and advantages of a holster according to the invention will become apparent from the following description of preferred embodiments thereof, provided only as non-limiting, indicative, examples, with reference to the accompanying drawings, in which.

DETAILED DESCRIPTION OF EMBODIMENTS OF THE INVENTION

According to the invention, as per the attached drawings, a holster is formed by one or more walls, which are connected each other through elastic means, preferably elastic cables. The walls delimit the containment area of the weapon. In this manner, starting from a minimum size of containment area of the weapon, this containment area can be increased in the event that a weapon of a larger size is inserted, because the elastic means yield elastically and allow the walls to move away from one another and then return to the original position as soon as the weapon is removed. Therefore, the containment area expands and contracts, thus returning to its initial position. As the weapon is reinserted, the insertion action generates a force on the holster walls, which causes those walls to move away from each other, and this removal movement is made possible by the connection via the elastic or anyway elasticized means.

In this manner, the containment area of the holster is variable and the holster is adaptable, as it adapts to guns of different sizes.

In this manner, if the holster has made in a standard size for a certain type of guns, it can also hold guns of different sizes.

A holster according the present invention is preferably made of a rigid plastic material, generally obtained in a mold.

Moreover, known systems for fastening the weapon may be integrated into the holster, but such systems do not form a specific object of the present invention and as such are not discussed further.

A holster according to present invention can also be equipped with known systems for fastening it to belts, suitable jackets, etc.

Figure 1:
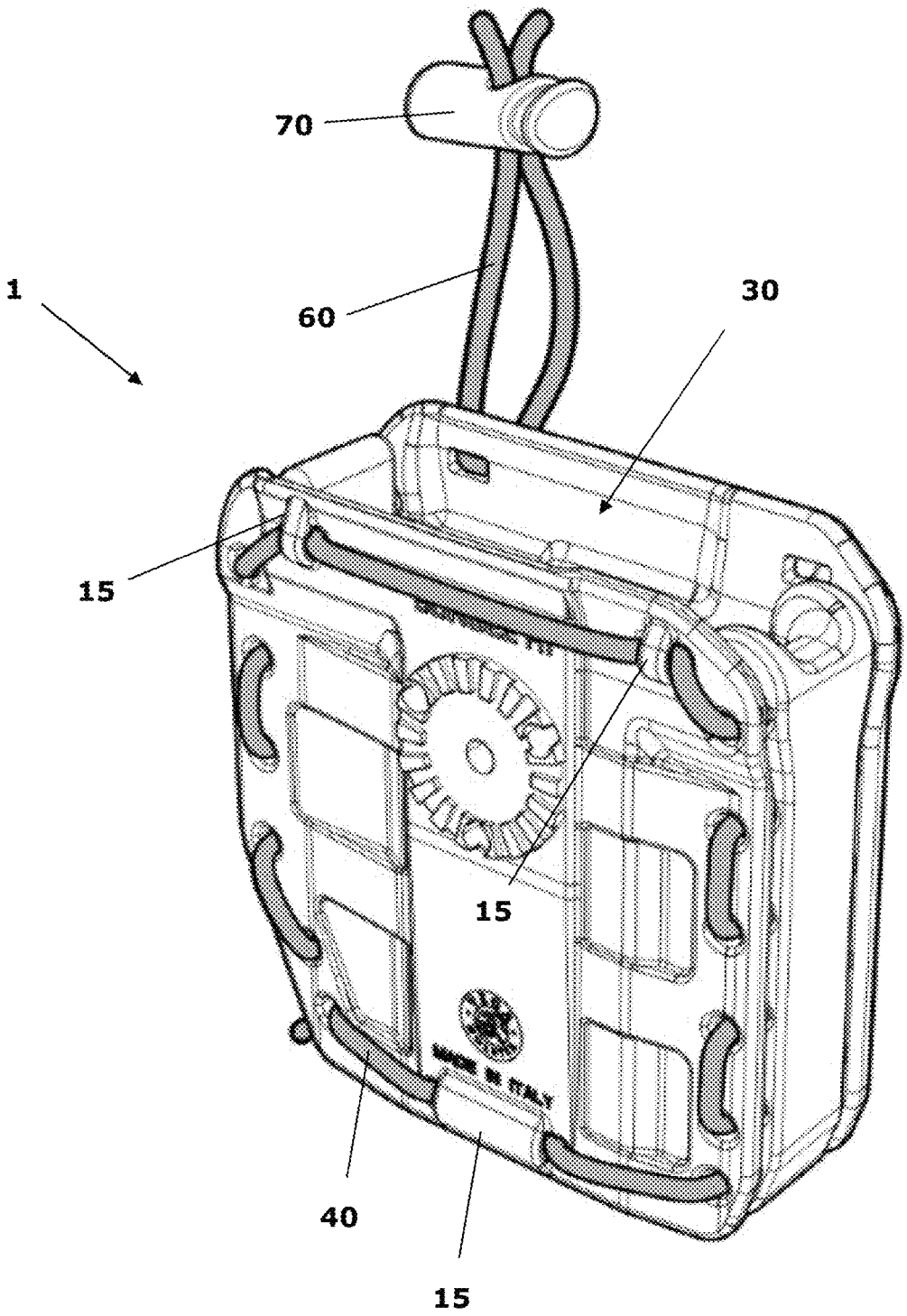
FIG. 1 depicts an axonometric view of a holster according to the present invention.
Figure 2:
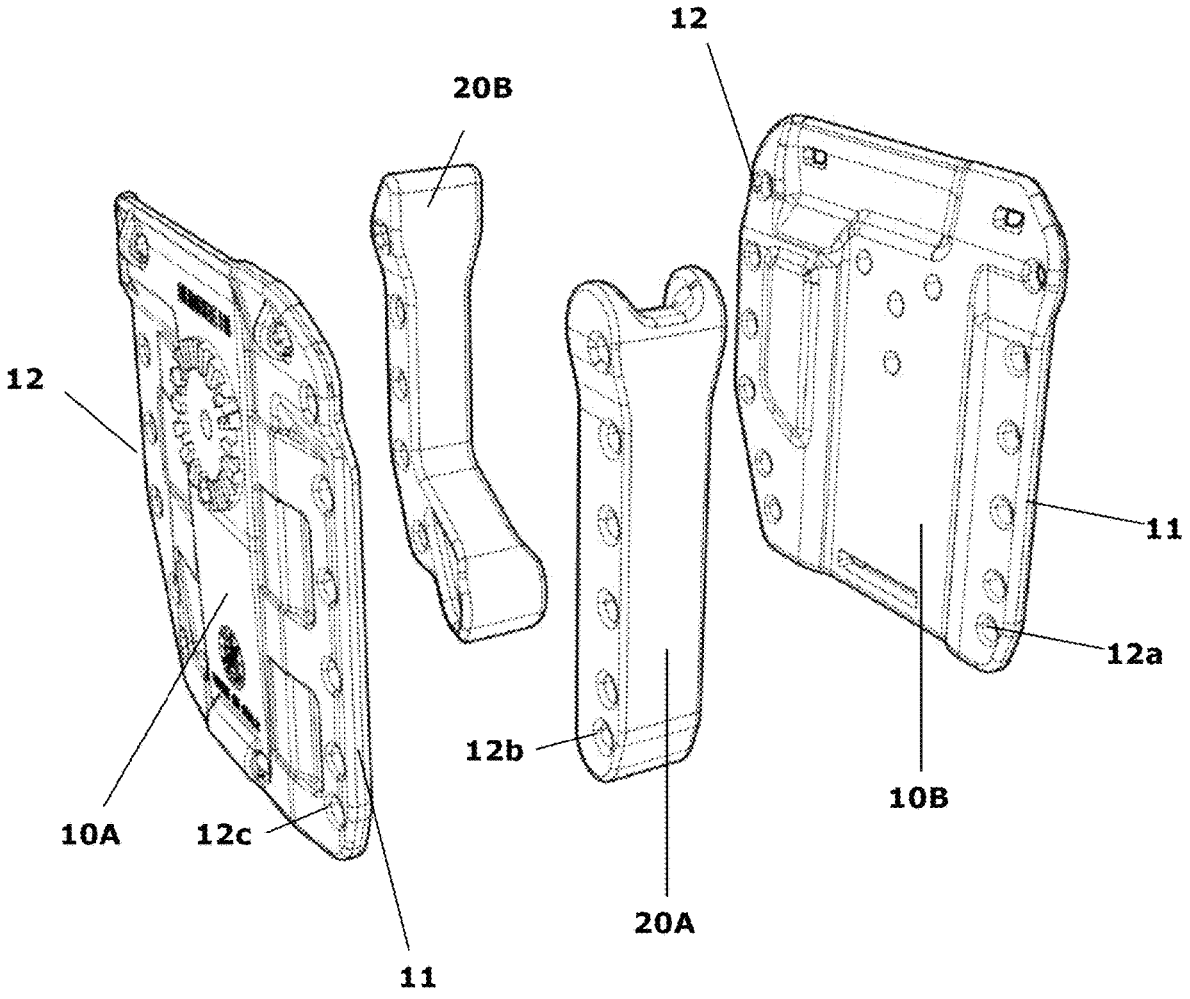
FIG. 2 depicts an exploded view of a holster according to the present invention.

Turning now to the axonometric view of FIG. 1 and the exploded view of FIG. 2 for a more detailed description of an embodiment of the present invention, a holster 1 may be formed by four walls (10A, 10B, 20A, 20B) detached from each other, which, when joined to each other, form a holster with an area 30 for receiving the firearm.

FIG. 2 shows in greater detail:

A front anterior wall 10A (which, in use, may be facing the outer part of the user's belt when the holster is worn on the belt or other support);

A front posterior wall 10B (which, in use, may be arranged in front of the front anterior wall 10A and be facing the user's belt or other support);

A lateral anterior wall 20A and a posterior lateral wall 20B, which are both interposed between the front anterior wall 10A and the front posterior one 10B so as to delimit an internal area 30, which is the containment area of the weapon.

Figure 3:
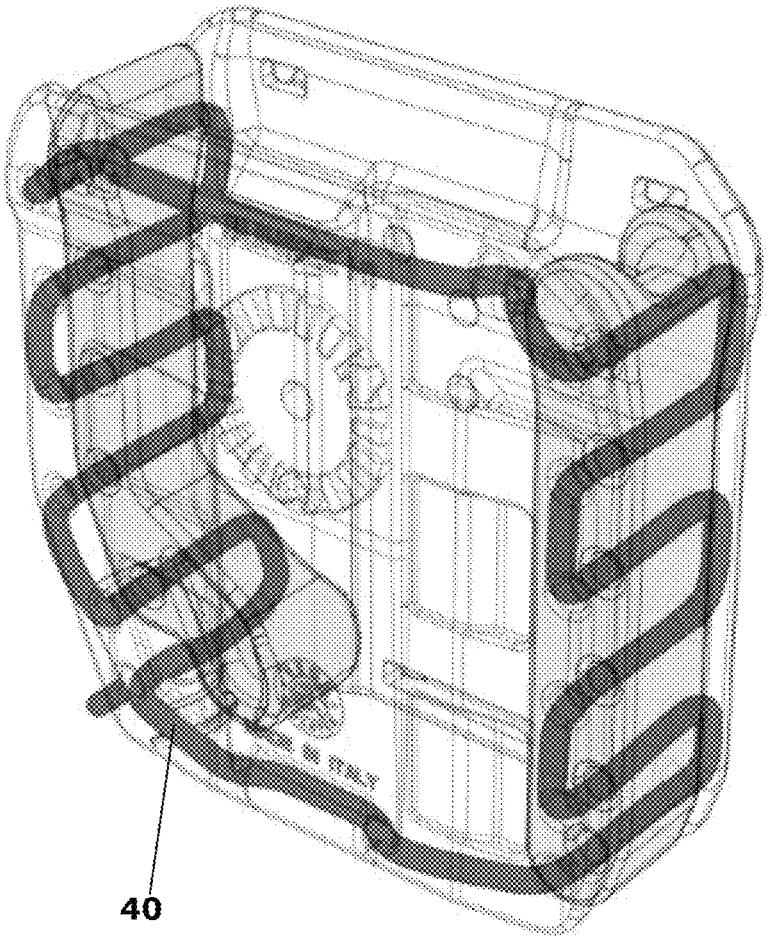
FIG. 3 depicts a non-limiting example of the passage of an elastic cable.

According to the invention, such four walls do not form a continuous and single piece as common holsters, but instead are four walls detached and separate from each other, which are suitably connected to each other by means of the passage of an elastic cable 40 of predetermined length (see FIG. 1 and FIG. 3).

As depicted in FIGS. 1 to 3, the lateral and front walls comprise holes and/or channels, which provide for a suitable passage of the cable, in a similar manner to shoelace eyelets for the passage of shoestrings.

For example, in the exploded view of FIG. 2, it can be seen that the two front walls (10A, 10B) have a sequence of through holes passing along sides 11 and 12, and that such holes are aligned with the corresponding channel defined in the lateral walls, so that the cable, while entering through a hole of the front wall, passes through the corresponding channel obtained in the lateral wall and then exits from it and can be inserted again in a corresponding hole of the other front wall.

This passage is depicted in FIG. 3, which shows the passage of the cable forming a sort of winding line joining the various parts to one another.

What is depicted in FIG. 3 is only one example, and many other arrangements for the passage of the cable are possible, which include using two or more elastic cables independent of each other.

Only by way of example, with reference to FIG. 2, it can be seen that hole 12*a* is aligned with channel 12*b* and hole 12*c* as the holster is being assembled. The same applies to the other holes.

The passage through a sequence of holes, arranged on a side, to the sequence of holes arranged on the other side of the front walls occurs by means of passage channels 15 (see FIG. 1).

The cable, once passed through the provided holes and channels, joins the four walls together, thus forming the holster and defining containment area 30 for the weapon.

The front walls can be identical to each other, therefore perfectly symmetric, or can be different from each other due to possible accessories.

For example, a front wall can be equipped with a standard joint for applying a standard loop 200 (known in the art) for fastening the holster to the belt while the other opposite front wall can lack such a joint.

As depicted in FIG. 3, the two lateral walls generally retrace the outline of the sides 11 and 12 of the front walls, therefore, the two lateral wall are not necessarily identical to each other if such two outlines of sides 11 and 12 are different from each other.

Obviously, any shape of the holster and thus of the single parts forming it can be provided without exceeding the scope of the present invention.

Figure 4:
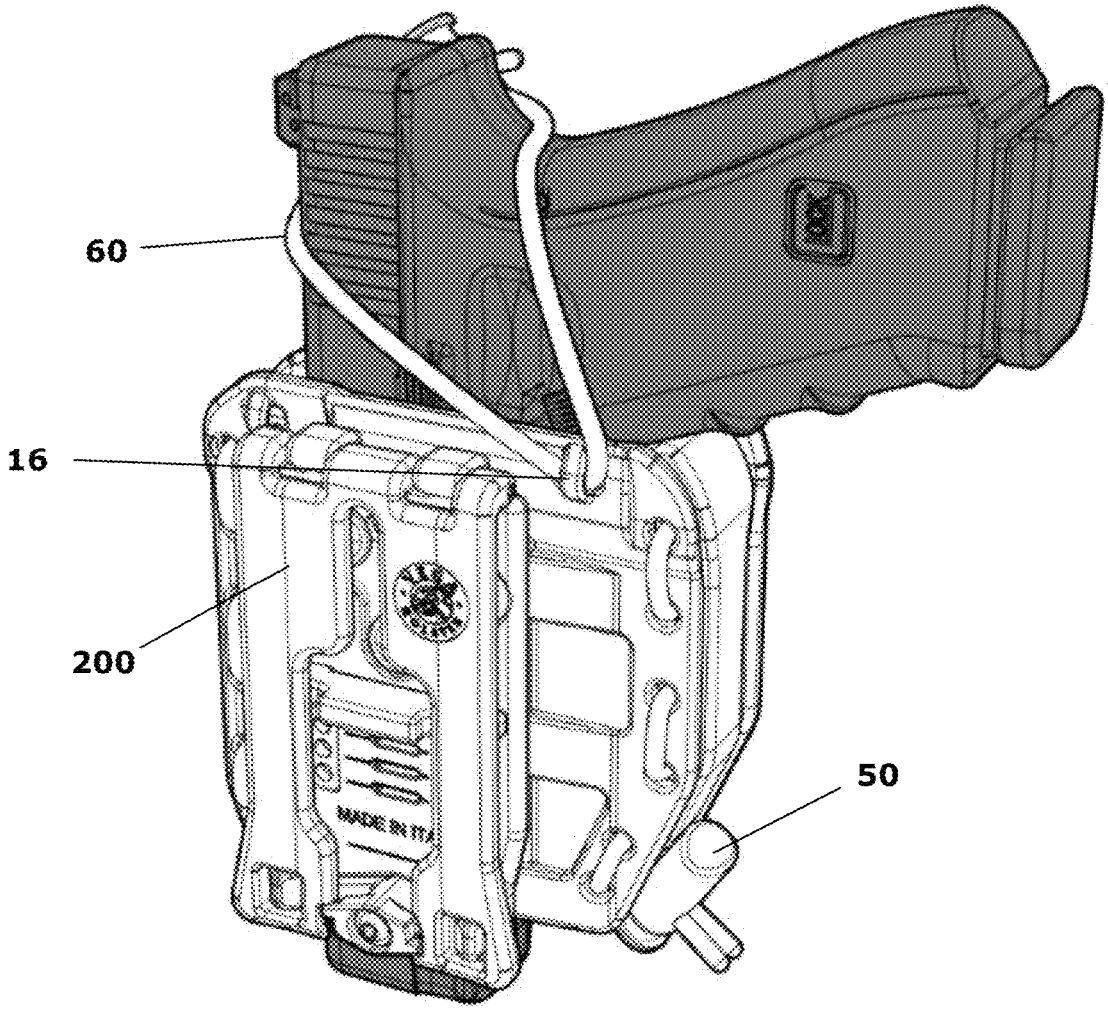
FIG. 4 and FIG. 5 depict a weapon inserted in a holster according to the invention and kept in position with an additional safety string, preferably of the elastic type.

For example, as depicted in FIG. 4, the elastic string (also called cable, which can be in the form of a strip) that is passed, is blocked at its two ends using a conventional toggle-stopper with push-button and spring (50), even if other blocking systems could be used, such as a simple knot.

That kind of toggle-stopper is known in the art and it is used, for example, in the clothing field. It comprises a passage for a cable, which is partially obstructed through a mobile contrasting element in an opening position by means of the external push-button. As soon as the external push-button is released, the element inside the passage goes back to the contrast position and partially closes the passage due to the action of a spring.

An additional cable 60, preferably but not necessarily elastic, passes through a suitable loop 16 in order to fasten the weapon on the butt for a safety fastening.

The passage of such cable could also be made on the cock of the weapon and by fixing the cable to the most suitable point.

Such a fastening system is not essential and could be replaced with other known fastening systems.

By using an elastic string 60 and adjusting the size of its noose, it can easily be extended so to fasten and rapidly block the cock of the weapon.

Further, string 60 is closed in a loop with a system 70 identical to the above described system 50 but it could also be closed in a loop with an equivalent system such as a simple knot.

String 60 may also be selected to have an appropriate size for fastening the butt of the weapon.

Figure 5:
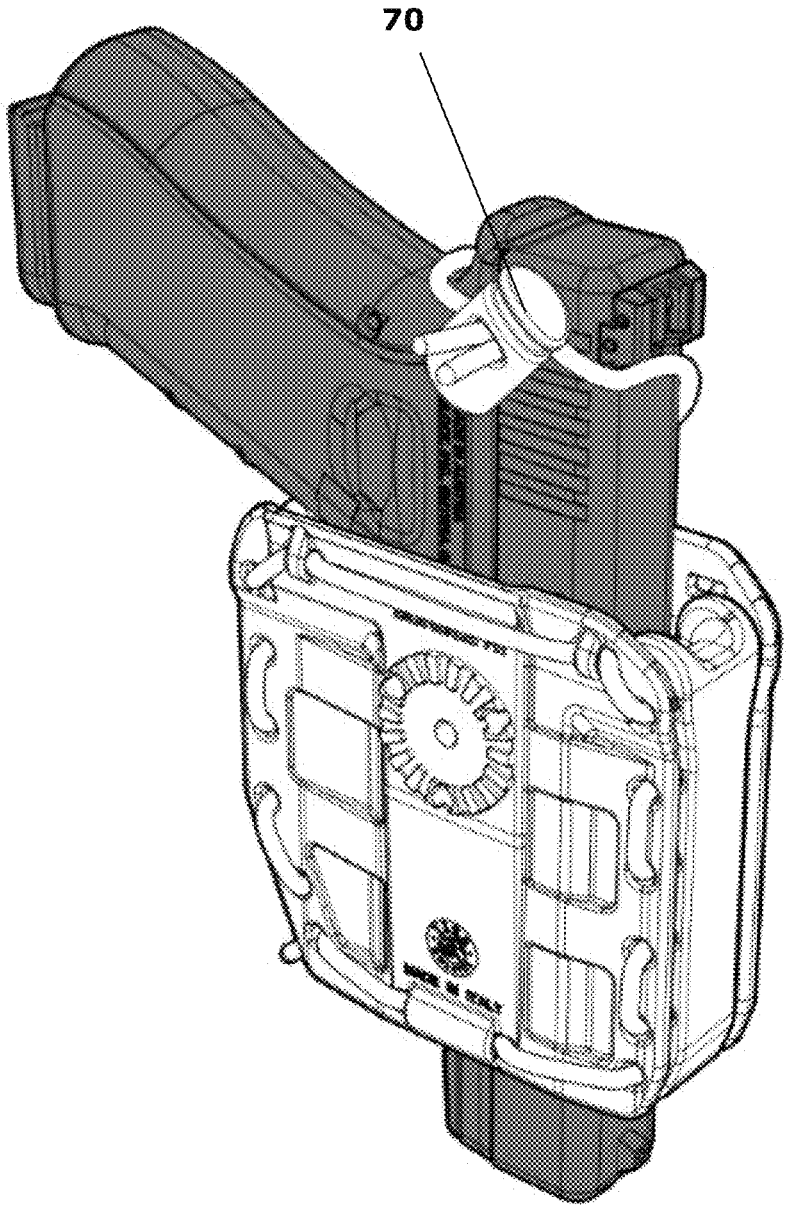
Figure 6:
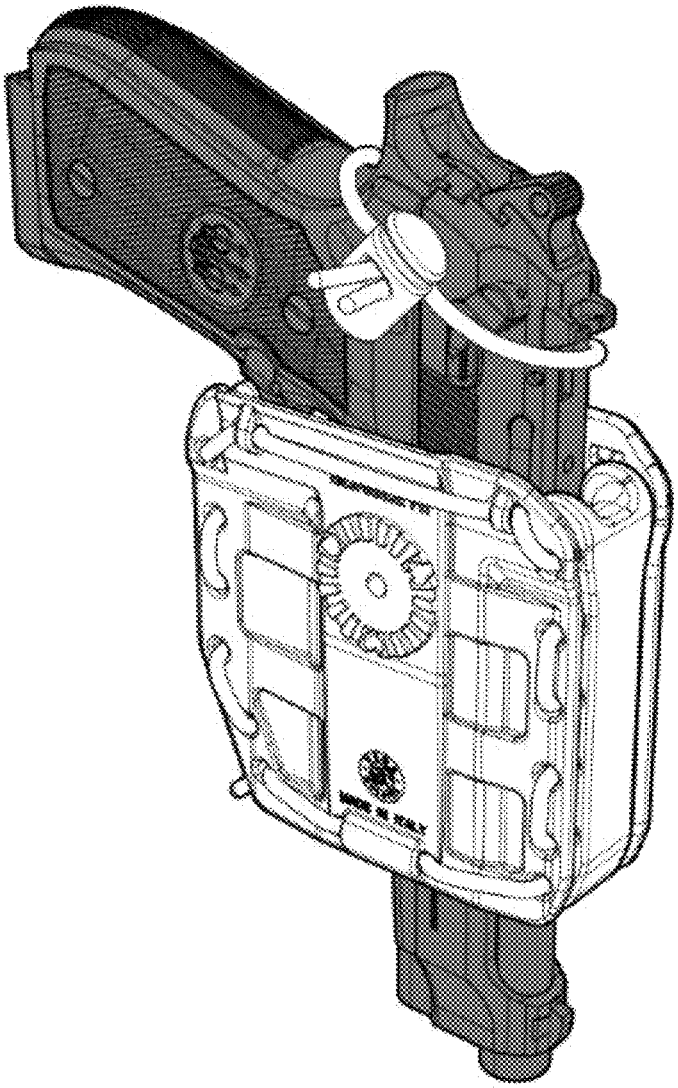
FIG. 6 depicts the insertion in the same holster of a different type of firearm.

FIG. 5 and FIG. 6 depict the insertion of two weapons of different types.

In fact, due to the use of the elastic cable, the two front walls 10A and 10B can move away from lateral walls 20A and 2*o*B if the length of the weapon exceeds the width of the lateral wall (20A, 20B).

In this manner, the holster can be adjusted to accommodate weapons of different sizes.

In an embodiment of the invention, elastic cable 40 could be replaced by an assembly of springs connecting the walls to each other, even if this embodiment is structurally more complex and as such may be found to be less preferable by some users.

In accordance with the present invention, the holster is preferably made by molding a rigid material such as a plastic material, and such technology may even be applied to other materials such as semi-rigid materials (rubber, for example) or even a fabric.

By suitably changing the shape of the walls, the present invention provides for realizing holster models for automatic guns, revolvers, and any other kind of guns.

Walls may be made that form a protuberance for the cylinder, thus providing for a holster adaptable to guns with different-sized cylinders. The same applies to automatic guns.

What has been described, even if preferably intended for holsters made from rigid or semi-rigid material, can also be produced with fabric holsters, even if such a solution may not be preferable for some users.

The invention claimed is:

1. A holster for a firearm, said holster comprising:

a front anterior wall;

a front posterior wall; and two lateral walls spaced from each other and respectively interposed between said front anterior and posterior walls so as to delimit an area for containing the firearm, wherein the front anterior wall, front posterior walls, and two lateral wall are provided as four separate members that delimit four sides of said area, a top and a bottom of said area being open for passage of at least a portion of said firearm through said holster, wherein said front anterior wall, said posterior wall, and said two lateral walls are connected to one another with an elastic element, wherein said elastic element is shaped at least as a cable or a strip of an elastic material, and wherein said front anterior wall and said front posterior wall comprise a plurality of channels for passage of the cable or the strip of the elastic material so that the cable or the strip keeps said front anterior wall, said front posterior wall, and two lateral walls joined to each other, thus shaping the holster, whereby, starting from a minimum initial size of the area for containing the firearm, the area increases according to an extension of the elastic element.

2. The holster, as per claim 1, wherein each of said lateral walls comprises along its length a succession of through channels for passage of the cable or the strip.

3. The holster, as per claim 2, wherein said front anterior and posterior walls comprise, on sides thereof, a succession of through holes aligned with said through channels arranged on the two lateral walls.

4. The holster, as per claim 1, wherein said front anterior, front posterior, and lateral walls forming the holster are made from a rigid or semirigid material.

5. The holster, as per claim 4, wherein said rigid or semirigid material is a plastic material.

6. The holster, as per claim 4, wherein said front anterior, front posterior, and lateral walls forming the holster are made by mold casting.

7. The holster, as per claim 1, further comprising one or more members that fasten the firearm to the holster and that are configured to acting on a part of the firearm.

8. The holster, as per claim 7, wherein the one or more members are shaped as a string fastened to one or more of the front anterior, front posterior, or lateral wall of the holster.

* * * * *